US007891514B1

(12) United States Patent
Walsh et al.

(10) Patent No.: US 7,891,514 B1
(45) Date of Patent: Feb. 22, 2011

(54) EASY OPEN AIR-TIGHT SEALED FOOD CONTAINER

(76) Inventors: Raymond Walsh, 900 NE. 18th Ave., No. 308, Fort Lauderdale, FL (US) 33304; Chuan Wu Wang, 900 NE. 18th Ave., No. 308, Fort Lauderdale, FL (US) 33304

( * ) Notice: Subject to any disclaimer, the term of this patent is extended or adjusted under 35 U.S.C. 154(b) by 165 days.

(21) Appl. No.: 12/360,663

(22) Filed: Jan. 27, 2009

(51) Int. Cl.
*B65D 6/28* (2006.01)
*B65D 8/18* (2006.01)
*B65D 41/16* (2006.01)

(52) U.S. Cl. ..... 220/4.21; 220/780

(58) Field of Classification Search ..... 220/4.21, 220/4.24, 4.26, 326, 378, 780, 789, 790, 220/796, 802
See application file for complete search history.

(56) References Cited

U.S. PATENT DOCUMENTS 3,749,277 A * 7/1973 Kinney ..... 220/785
6,056,138 A * 5/2000 Chen ..... 220/4.21
6,196,404 B1 * 3/2001 Chen ..... 220/4.21
6,460,716 B1 * 10/2002 Wong ..... 220/4.24
7,055,712 B2 * 6/2006 Tang ..... 220/4.21
7,735,674 B2 * 6/2010 Cai ..... 220/324

* cited by examiner

*Primary Examiner*—Harry A Grosso
(74) *Attorney, Agent, or Firm*—Daniel S. Polley, P.A.

(57) ABSTRACT

A food and liquid container is disclosed having a base and lid and providing for an air-tight seal between the base and lid when they are attached to each other. The seal is achieved at several points which create two air-pockets. The securing portion associated with the base can be substantially J-shaped in cross section, while the securing portion of the lid can be substantially u-shaped in cross section. A first ridge on the J-shaped section abuts with a second ridge on the u-shaped section when the lid is attached to the base with the second ridge disposed above the first ridge. The lower outer end of the u-shaped section can be rounded and a lip can extend outward for easier gripping when removing the lid from the base.

20 Claims, 4 Drawing Sheets

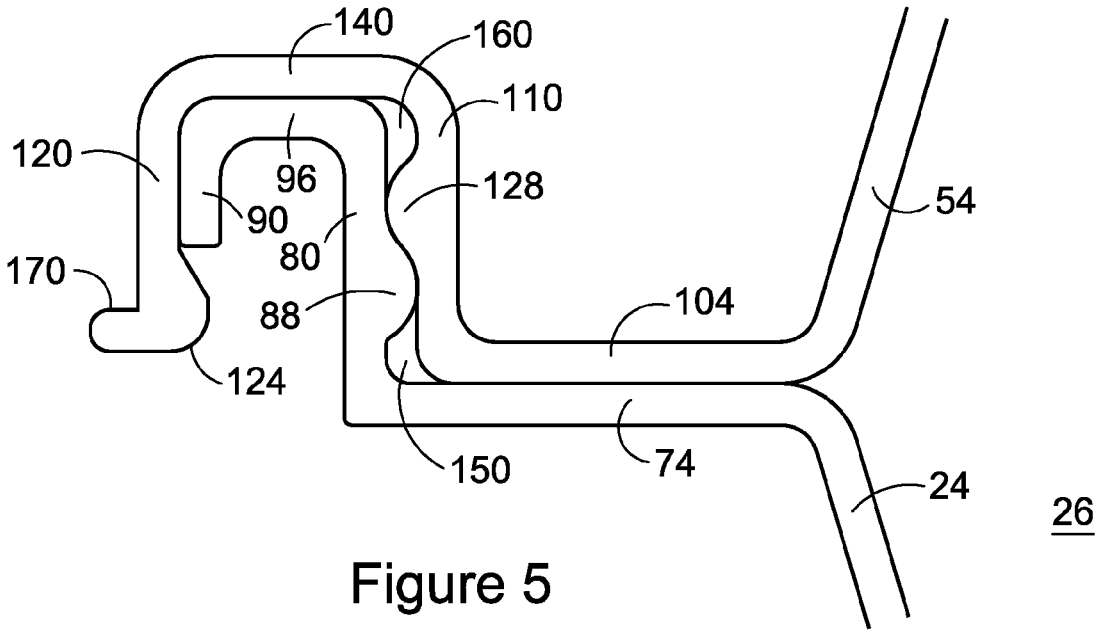
Figure 5
Figure 6
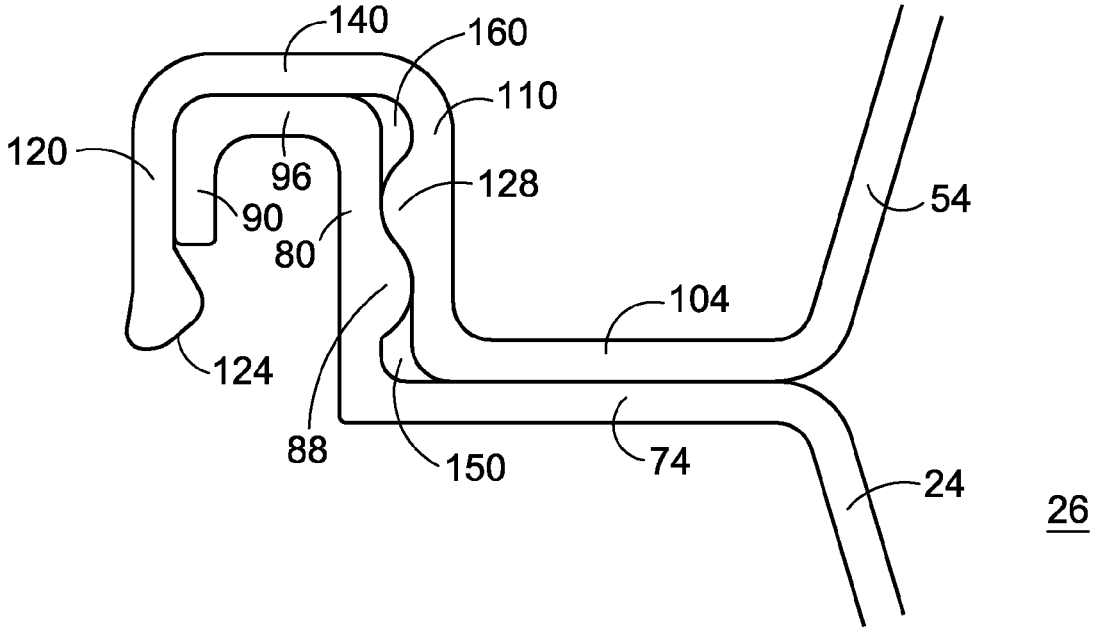

EASY OPEN AIR-TIGHT SEALED FOOD CONTAINER

FIELD OF THE INVENTION

The invention relates generally to containers and more particularly to containers for sealing food.

BACKGROUND OF THE INVENTION

Restaurants, such as, but not limited to, Asian and Italian restaurants, are known for using take-away food and liquid containers for leftovers and to go orders. Though the use of containers for food and liquid items has existed for quite some time, problems with leakage and easy removable of the container lids still exist. The present invention is directed to reducing, if not eliminating these problems with conventional containers and provides an improved food container, ideal for use with take-away and to go food and liquid items.

SUMMARY OF THE INVENTION

The present invention discloses a food container, preferably for hot and liquid take-away food. However, the present invention is not considered limited for use only with hot and liquid take-away food and other uses for the present invention can be used and are considered within the scope of the invention. The present invention container generally contains a base and lid. When the lid is properly secured to the based a substantially air-tight seal is formed, which greatly reduces, if not eliminates, spillage or leakage of the food and/or liquid stored within the container. In one embodiment, at least one portion of the lid can be provided with an extended lip which permits for easier removal of the lid from its securement to the base. The lid lip also allows the user to permit steam to escape, with some control, to reduce injury to the user when opening the container.

The lid can also be provided with a novel flange which is provided with a smooth edge and is slightly rounded. To secure the lid to the base, the edge of the lid is placed over the base and snaps closed tightly in place.

The lid of the present invention can also be provided with a bubble-like ridge on an upper portion of its vertical side that meets or abuts with the base. The rounded flange of the lid extends over the base on a downward portion of the exterior of the base. As mentioned above, the lid can also be provided with an extended lip, though such is not considered limiting.

At its sealing area, the base can also be provided with a bubble-like ridge on a lower portion of the vertical side of the base that meets or abuts with the lid. The lower end of the outermost vertical side can be smooth/rounded so as not to cause pain or discomfort to the user when removing the lid from attachment to the base.

When securing the lid to the base, the rounded edge snaps over the base straight rim edge and the two above-described bubble-like ridges meet to form a substantially air-tight or air-tight seal. The present invention container can be provided with three additional seals formed by the abutment of the base rim with the lid rim when the base and lid are properly attached to each other. Two air-pockets can be formed above and below the abutting bubbled ridges, when the lid is properly secured to the container. When properly secured, the bubble-ridge of the base is positioned below the bubble ridge of the lid.

To remove the lid from its securement to the base, the extended lid lip is pulled, pushed or otherwise moved upward which allows the bubble ridge of the lid to separate from its abutment to the bubble ridge of the base, permitting the container to be easily opened, while at the same time permitting any steam buildup to safely escape with burning the user's hands. The preferable smooth edge at the bottom of the lid rim of the present invention permits for easy carrying and operation without the user experiencing a sharp lid rim edge common with current container lids. Thus, the present invention provides for a more functional, safe and user friendly food and liquid container as compared to the containers currently in use.

BRIEF DESCRIPTION OF THE DRAWINGS

FIG. 5 is a sectional view showing the attachment of the base securement portion to the lid securement portion in accordance with a second embodiment of the present invention and illustrating an extended edge section of the lid securement portion;

FIG. 6 is a sectional view showing the attachment of the base securement portion to the lid securement portion in accordance with the first or second embodiment of the present invention and illustrating a non-extended edge or non-lip section of the lid securement portion.

DETAILED DESCRIPTION OF THE DRAWINGS

Figure 4:
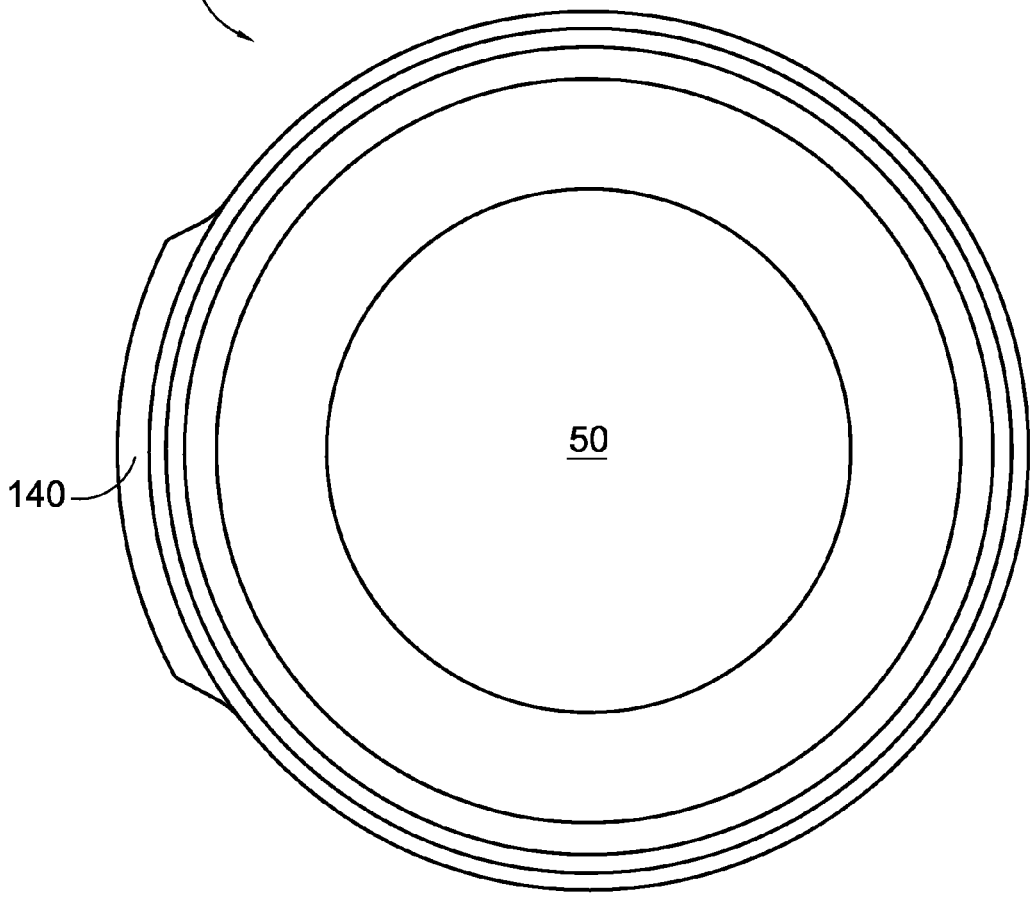
FIG. 4 is a non-limiting circular shaped container having the lid and base securement portions of FIG. 1.

As seem in FIGS. 1 through 4, a first embodiment for a food container is generally shown and designated as food and liquid container 10. Container 10 is not limited to any particular shape and as non-limiting examples can be seen as generally rectangular in shape (FIG. 3) or generally circular in shape (FIG. 4). Other shape examples that are within the scope of the invention include, but are not limited to, square, elliptical, parallelogram, rhombus, oval, diamond, round, etc.

Container 10 generally comprises a base 20 and a lid 50 and is preferably used to store or hold food and/or liquid. In use, lid 50 is removably secured to base 20 in an air-tight or at least substantially air-tight relationship. Base 20 includes a bottom surface a bottom surface and a sidewall 24 extending upward from the bottom surface. The bottom surface and sidewall 24 define a food and liquid storage area 26. Lid 50 includes a top surface and a sidewall 54 extending downward from the top surface.

Figure 1:
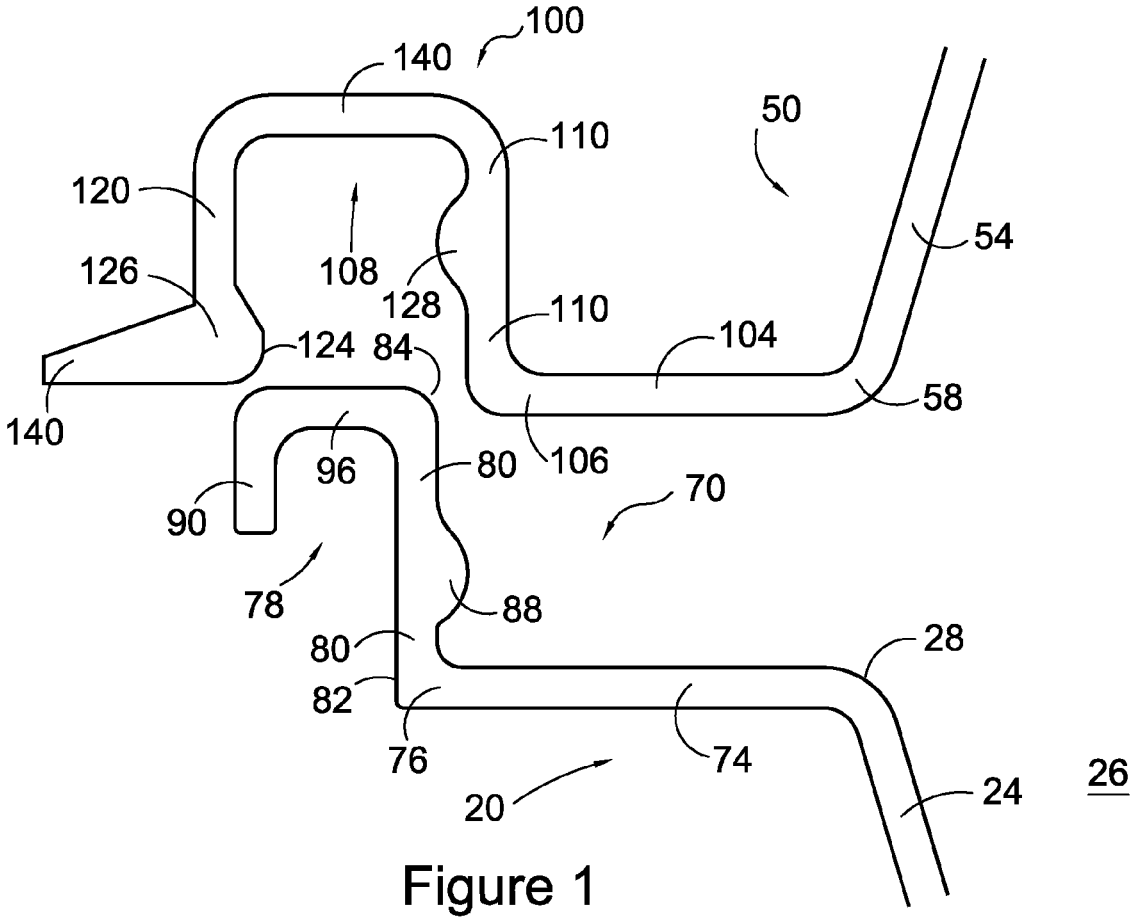
FIG. 1 is a sectional exploded view of the base securement portion and the lid securement portion in accordance with a first embodiment of the present invention.
Figure 2:
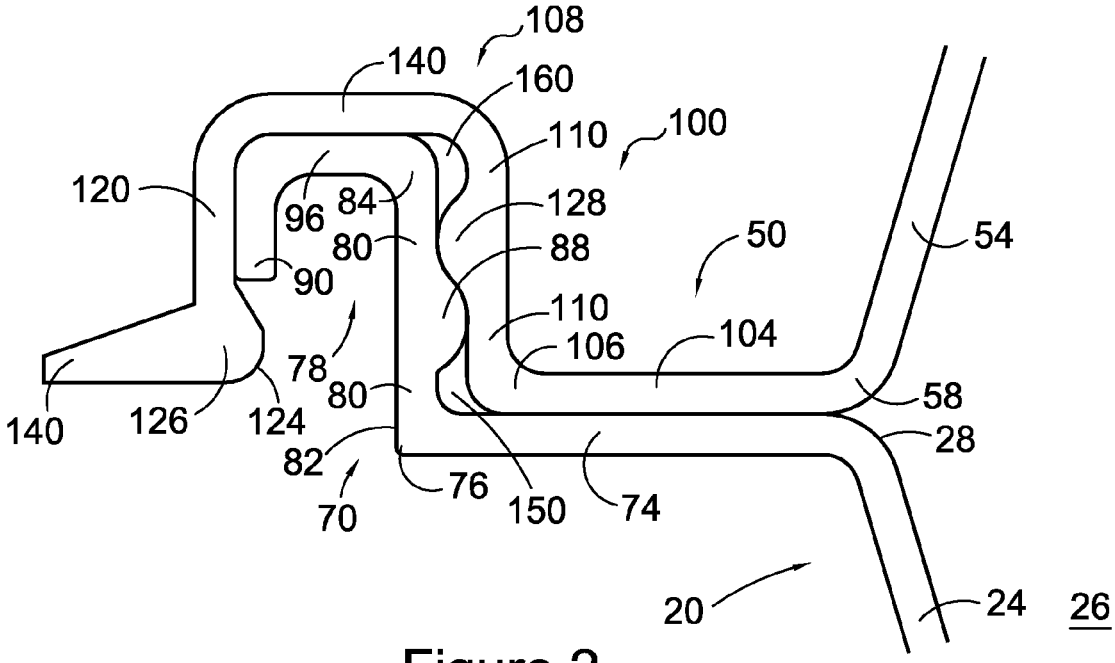
FIG. 2 is a sectional view showing the attachment of the base securement portion to the lid securement portion of FIG. 1 in accordance with the present invention.
Figure 3:
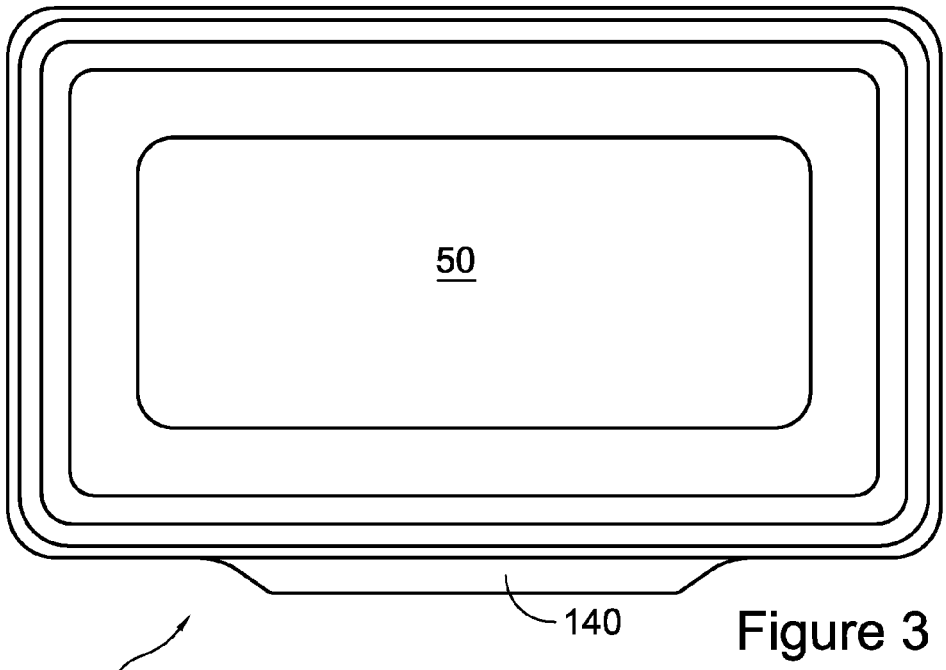
FIG. 3 is a non-limiting rectangular shaped container having the lid and base securement portions of FIG. 1.

As shown in cross-sectional detail in FIGS. 1 and 2, container 10 is provided with a mean for securing lid 50 to base 20 in at least a substantially air-tight, if not air-tight, relationship. Means for securing 50 consists of two portions, a first portion associated with base 20 and a second portion associated with lid 50.

The first securement portion is generally designated as rim or portion 70 and extends outward from a top end 28 of base sidewall 24. First securement portion 70 includes a horizontal or substantially horizontal first section 74 having an outer end 76 and an inverted substantially J-shaped cross-sectional shape section 78 disposed at outer end 76 of first horizontal section 74. J-shaped section 78 includes a first vertical segment 80, a second vertical segment 90 having a length shorter than a length of first vertical segment 80 and a first intermediate segment 96 disposed between first vertical segment 80 and second vertical segment 90. First vertical segment 80 has a first ridge 88 extending outward toward base 10. First ridge 88 is disposed between a lower end 82 and an upper end 84 of first vertical segment 80.

The second securement portion is generally designated as rim or portion 100 and extends outward from a bottom end 58 of lid sidewall 54. Second securement portion 100 includes a horizontal or substantially horizontal second section 104 having an outer end 106 and an inverted substantially u-shaped cross-sectional shape section 108 disposed at outer end 106 of second horizontal section 104. u-shaped section includes a third vertical segment 110, a fourth vertical segment 120 and a second intermediate segment 140 disposed between third vertical segment 110 and fourth vertical segment 120. Third vertical segment 110 has a second ridge 128 extending inward away from lid 50.

First horizontal section 74 is preferably longer in length than the length of second horizontal section 104. Additionally, second intermediate segment 140 is longer in length than the length of first intermediate segment 96.

Fourth vertical segment 120 is preferably provided with a rounded smooth area 124 at its lower end area 126 for contact by one or more of the user's fingers when removing lid 50 from its attachment to base 20. Prior art lids are known to terminate at a point at their lower ends which creates a sharp edge, and can cause discomfort or a pricking feeling to the user's fingers when pressure or force is applied by the user to remove the prior art lid. Rounded and/or smooth area 124 eliminates this discomfort and thus provides for an easier and more enjoyable experience when removing lid 50 from attachment to base 20, as compared to the removal of prior art lids. Rounded area 124 also can provide for a snap fit with second vertical segment 90.

To provide for more surface area to grab onto when removing lid 50, a portion of second securement portion 100 can be provided with an outwardly extending lip 140, preferably at lower area 126 of fourth vertical segment 120. Though not preferred, it is also within the scope of the invention to have lip 140 extend outward from fourth vertical segment 120 from a top area or intermediate area of segment 120.

Lid 50 and second securement portion 100 are preferably monolithically formed or constructed integral as a one-piece member. Additionally, base 20 and first securement portion 70 are preferably monolithically formed or constructed integral as a one-piece member.

When lid 50 is secured to base 20 first horizontal section 74 and second horizontal section 104 are abutting each other, first intermediate segment 96 and second intermediate segment 140 are abutting each other, second vertical segment 90 and fourth vertical segment 120 are abutting each other and first ridge 88 is abutting second ridge 128. In this attached relationship, first ridge 88 is disposed below second ridge 128, which permits for easier removal of lid 50 from base 20 by the user, since first ridge 128 does not have to overcome first ridge 88 to remove lid 50. These abutting relationships provide for an at least substantially air-tight, if not air-tight, seal for the connection of lid 50 to base 20.

Pulling up on lip 140 by the user allows ridge 128 to easily separate from first ridge 88 as it is located above first ridge 88, thus permitting lid 50 to be easily removed from base 20 and reducing the chance of spilling some of the contents contained within storage area 26 when opening container 10. Though one lip 140 is illustrated and preferred, it should be recognized that lid 50 can be provided with a plurality of lips 140.

With the attachment of lid 50 to base 20 and the contact or sealing points described above in the preceding paragraph, a first air pocket 150 is defined between first vertical segment 80 and third vertical segment 110 below the abutting relationship between first ridge 88 and second ridge 128. A second air pocket 160 is also created with the attachment of lid 50 to base 20 and is defined between first vertical segment 80 and third vertical segment 110 above the abutting relationship between first ridge 88 and second ridge 128. Thus, as mentioned above, the attachment of lid 50 to base 20 provides a substantially air-tight, if not airtight, seal between base 20 and lid 50.

The lengths of the various segments are chosen such that the abutting relationships between segments describe above, creates a tight and sealed relationship.

FIG. 5 illustrates an alternative embodiment for the present invention, which eliminates lip 140. In place of lip 140, an outwardly extended or exaggerated edge 170 is created for a portion of fourth vertical segment 120, which provides for a larger gripping area for the user's fingers. Extended edge can also be round and smooth so as to provide for a comfortable and safer grip for the user. Similar parts of the first embodiment also found in the second embodiment are numbered the same.

Figure 7:
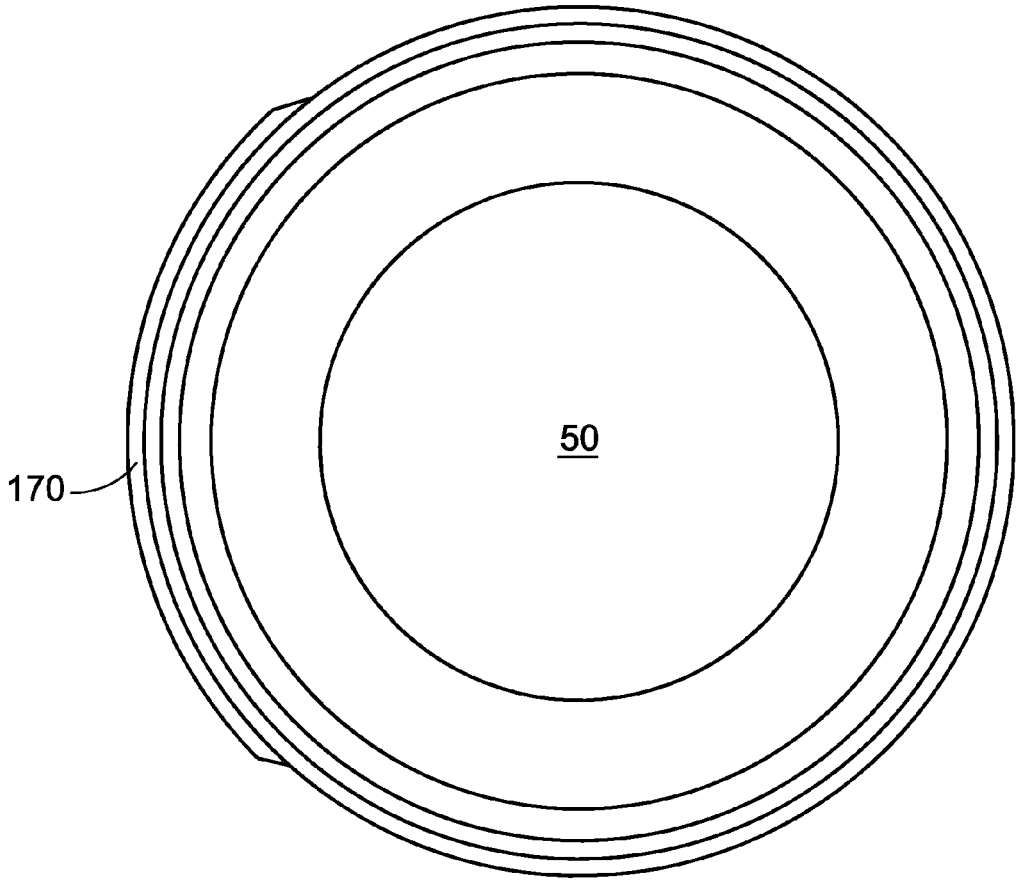
FIG. 7 is a non-limiting circular shaped container illustrating the second embodiment securement of the lid to the base.

FIG. 7 illustrates a top view of the extended edge 170. It should be understood that the length of edge 170 is not limited to any particular portion and can extend for any length. Though one extended edge 170 is illustrated and preferred, it should be recognized that lid 50 can be provided with a plurality of extended edges 170, and that the edges 170 can be of the same length, but are not required to be of the same length.

A cross-sectional view of the portion of fourth vertical segment 120 not having lip 140 or extended edge 170 is shown in FIG. 6.

One non-limiting use for container 10 is a take-away container for hot liquids and food. In view of its above-described configuration, container 10 is easily opened, while providing for a very tight non-leaking seal. Additionally, by preferably having smooth and round edges, container 10 provides for easy and safe handling.

Containers 10 can be preferably stackable, microwavable and/or recyclable. Containers 10 can come in varying sizes and shapes and all are considered within the scope of the invention. Thus, container 10 is not limited to any particular size and/or shape. Container 10 is not limited to any particular material for construction and can be constructed from any material used for constructing containers, which are leak proof. One non-limiting material that can be used for the construction of base 20 and/or lid 50 (i.e. container 10) can be plastic, though other materials can be used and are considered within the scope of the invention. Lids 50 can also be stackable within each other for easy storage. Likewise base 20 can also be stackable within each other for easy storage.

Lid 50 and/or base 20 can also be constructed such that at least a portion is transparent or translucent so that the stored contents within container 10 can be viewed without having to detach lid 50 from its securement to base 20.

It will be seen that the objects set forth above, and those made apparent from the foregoing description, are efficiently attained and since certain changes may be made in the above construction without departing from the scope of the invention, it is intended that all matters contained in the foregoing description shall be interpreted as illustrative and not in a limiting sense. The instant invention has been shown and described herein in what is considered to be the most practical and preferred embodiment.

What is claimed is:

1. A food and liquid container, comprising:

a base having a bottom surface and a sidewall extending upward from said bottom surface, said bottom surface and sidewall defining a food and liquid storage area;

a lid having a top surface and a sidewall extending downward from said top surface;

means for securing said lid to said base in an at least a substantially air tight relationship, said means for securing comprises:

a first securement portion extending outward from a top end of said base sidewall, said first securement portion having a substantially first horizontal section having an outer end and a first outer section having an inverted substantially J-shaped cross-sectional shape disposed at the outer end of said first horizontal section, said J-shaped section defined by a first vertical segment, a second vertical segment having a length shorter than a length of said first vertical segment and a first intermediate segment disposed between said first vertical segment and said second vertical segment, said first vertical segment having a first ridge extending toward said base;

a second securement portion extending outward from a bottom end of said lid sidewall, said second securement portion having a substantially second horizontal section having an outer end and an second outer section having an inverted substantially u-shaped cross-sectional shape disposed at the outer end of said second horizontal section, said u-shaped section defined by a third vertical segment, a fourth vertical segment and a second intermediate segment disposed between said third vertical segment and said fourth vertical segment, said third vertical segment having a second ridge extending away from said lid;

wherein when said lid is secured to said base said first horizontal section and second horizontal section are abutting each other, said first intermediate segment and said second intermediate segment are abutting each other, said second vertical segment and said fourth vertical segment are abutting each other and said first ridge is abutting said second ridge and wherein a first air pocket is defined between said first vertical segment and said third vertical segment below said first ridge and said second ridge and a second air pocket is defined between said first vertical segment and said third vertical segment above said first ridge and said second ridge.

2. The container of claim 1 wherein said first ridge is below said second ridge when said lid is secured to said base.

3. The container of claim 1 wherein said lid and said second securement portion are monolithically formed as a one-piece member and said base and said first securement portion are monolithically formed as a one-piece member.

4. The container of claim 1 wherein said fourth vertical segment having a rounded smooth lower end area which is contacted by one or more of the user's fingers when removing the lid from its attachment to the base.

5. The container of claim 1 wherein said fourth vertical segment having an exaggerated outward rounded smooth lower end which is contacted by one or more of the user's fingers when removing the lid from its attachment to the base.

6. The container of claim 1 wherein said first vertical segment, said second vertical segment, said third vertical segment and said fourth vertical segment are all substantially circular in shape.

7. The container of claim 1 wherein said first vertical segment, said second vertical segment, said third vertical segment and said fourth vertical segment are all having a substantially parallelogram shape.

8. The container of claim 1 further comprising at least one lip gripping member extending outward from said fourth vertical segment.

9. The container of claim 1 wherein a portion of said fourth vertical segment extends outward to provide an enlarged gripping surface.

10. The container of claim 1 wherein the attachment of said first securement portion to said second securement portion provides a substantially air-tight seal between said base and said lid.

11. The container of claim 1 wherein said first horizontal section is longer in length than said second horizontal section.

12. The container of claim 1 wherein said second intermediate segment is longer in length than said first intermediate segment.

13. A food and liquid container, comprising:

a base having a bottom surface and a sidewall extending upward from said bottom surface, said bottom surface and sidewall defining a food and liquid storage area;

a lid having a top surface and a sidewall extending downward from said top surface;

means for securing said lid to said base in an at least a substantially air tight relationship, said means for securing comprises:

a first securement portion monolithically formed with and extending outward from a top end of said base sidewall, said first securement portion having a substantially first horizontal section having an outer end and a first outer section having an inverted substantially J-shaped cross-sectional shape disposed at the outer end of said first horizontal section, said J-shaped section defined by a first vertical segment, a second vertical segment having a length shorter than a length of said first vertical segment and a first intermediate segment disposed between said first vertical segment and said second vertical segment, said first vertical segment having a first ridge extending toward said base, said first ridge intermediately disposed between a top end and a lower end of said first vertical segment;

a second securement portion monolithically formed with and extending outward from a bottom end of said lid sidewall, said second securement portion having a substantially second horizontal section having an outer end and an second outer section having an inverted substantially u-shaped cross-sectional shape disposed at the outer end of said second horizontal section, said u-shaped section defined by a third vertical segment, a fourth vertical segment and a second intermediate segment disposed between said third vertical segment and said fourth vertical segment, said third vertical segment having a second ridge extending away from said lid, said second ridge intermediately disposed between a top end and a lower end of said third vertical segment;

wherein when said lid is secured to said base said first horizontal section and second horizontal section are abutting each other, said first intermediate segment and said second intermediate segment are abutting each other, said second vertical segment and said fourth vertical segment are abutting each other and said first ridge is below and abutting said second ridge and wherein a first air pocket is defined between said first vertical segment and said third vertical segment below said first ridge and said second ridge and a second air pocket is defined between said first vertical segment and said third vertical segment above said first ridge and said second ridge;

wherein the attachment of said first securement portion to said second securement portion provides a substantially air-tight seal between said base and said lid.

14. The container of claim 13 wherein said fourth vertical segment having a rounded smooth lower end area which is contacted by one or more of the user's fingers when removing the lid from its attachment to the base.

15. The container of claim 13 wherein said first vertical segment, said second vertical segment, said third vertical segment and said fourth vertical segment are all similar in shape.

16. The container of claim 13 further comprising at least one lip gripping member extending outward from said fourth vertical segment.

17. The container of claim 13 wherein a portion of said fourth vertical segment extends outward to provide an enlarged gripping surface.

18. A food and liquid container, comprising:

a base having a bottom surface and a sidewall extending upward from said bottom surface, said bottom surface and sidewall defining a food and liquid storage area;

a lid having a top surface and a sidewall extending downward from said top surface;

means for securing said lid to said base in an at least a substantially air tight relationship, said means for securing comprises:

a first securement portion monolithically formed with and extending outward from a top end of said base sidewall, said first securement portion having a substantially first horizontal section having an outer end and a first outer section having an inverted substantially J-shaped cross-sectional shape disposed at the outer end of said first horizontal section, said J-shaped section defined by a first vertical segment, a second vertical segment having a length shorter than a length of said first vertical segment and a first intermediate segment disposed between said first vertical segment and said second vertical segment, said first vertical segment having a first ridge extending toward said base, said first ridge intermediately disposed between a top end and a lower end of said first vertical segment;

a second securement portion monolithically formed with and extending outward from a bottom end of said lid sidewall, said second securement portion having a substantially second horizontal section having an outer end and an second outer section having an inverted substantially u-shaped cross-sectional shape disposed at the outer end of said second horizontal section, said u-shaped section defined by a third vertical segment, a fourth vertical segment and a second intermediate segment disposed between said third vertical segment and said fourth vertical segment, said third vertical segment having a second ridge extending away from said lid, said second ridge intermediately disposed between a top end and a lower end of said third vertical segment, said first horizontal section is longer in length than said second horizontal section and said second intermediate segment is longer in length than said first intermediate segment;

wherein when said lid is secured to said base said first horizontal section and second horizontal section are abutting each other, said first intermediate segment and said second intermediate segment are abutting each other, said second vertical segment and said fourth vertical segment are abutting each other and said first ridge is below and abutting said second ridge and wherein a first air pocket is defined between said first vertical segment and said third vertical segment below said first ridge and said second ridge and a second air pocket is defined between said first vertical segment and said third vertical segment above said first ridge and said second ridge;

wherein said fourth vertical segment having a rounded smooth lower end area which is contacted by one or more of the user's fingers when removing the lid from its attachment to the base;

wherein the attachment of said first securement portion to said second securement portion provides a substantially air-tight seal between said base and said lid.

19. The container of claim 18 further comprising at least one lip gripping member extending outward from said fourth vertical segment.

20. The container of claim 18 wherein a portion of said fourth vertical segment extends outward to provide an enlarged gripping surface.

* * * * *